US005385215A

United States Patent [19]

Williams et al.

[11] Patent Number: 5,385,215

[45] Date of Patent: Jan. 31, 1995

[54] SCAFFOLDING JACK SYSTEM

[76] Inventors: James L. Williams, 19534 Lost River Rd., Seminole, Ala. 36574; Gene Phillips, P.O. Box 726, Gonzalez, Fla. 32560

[21] Appl. No.: 219,251

[22] Filed: Apr. 1, 1994

[51] Int. Cl.[6] ..... E04G 1/14

[52] U.S. Cl. ..... 182/179; 182/113; 49/57

[58] Field of Search ..... 182/179, 178, 113; 49/57, 463, 124

[56] References Cited

U.S. PATENT DOCUMENTS 2,635,717 4/1953 Albrecht et al. ..... 182/179 X 3,490,559 1/1970 Torch et al. ..... 182/119 X 3,850,264 11/1974 Salinas ..... 182/178

4,438,596 3/1984 Jones et al. ..... 182/113 X 5,069,309 12/1991 Swiderski et al. ..... 182/119

*Primary Examiner*—Alvin C. Chin-Shue

*Attorney, Agent, or Firm*—Peter Loffler

[57] ABSTRACT

The present invention provides for an improved scaffolding jack system. The present invention provides the top bar that connects the inside vertical posts to the outside vertical posts to have a slidable gate received within the top bar. In a closed position the sliding gate connects the top bar to the inside vertical post and can bear a normal load. In an open position, the sliding gate slides into the top bar to permit a worker to pass easily.

8 Claims, 2 Drawing Sheets

SCAFFOLDING JACK SYSTEM

BACKGROUND OF THE INVENTION

Scaffolding is a familiar sight at construction projects. It plays an integral role in the building process. Scaffolding hugs the sides of a rising building almost from the start.

Many players in building construction make use of the scaffolding gripping the building. These players include the painters, carpenters, brick masons, inspectors, and so on. The standard scaffolding used on today's construction sites offer many conveniences to the construction workers. However, the scaffolding extends drawbacks as well.

The scaffolding found on many job sites is of a typical construction. Vertical posts, approximately four feet in height, are erected to form a rectangular perimeter. The perimeter will typically have a length of seven to eight feet and a width of four to five feet.

Horizontal bottom bars connect the vertical posts width wise.

Brace bars connect the vertical posts that define the length to one another. These brace bars are positioned diagonally and cross over one another to form an "X" between two vertical posts. Both sets of vertical posts that define the length are so braced. These braces give the scaffolding strength and structural integrity.

In order to strengthen the scaffolding along its width a top bar connects the two vertical posts that define the width. This top bar is placed on both widths of the scaffolding. A center post connects the top to the bottom bar on each side. A plank rest bar connects the center post to one of the vertical posts.

This configuration provides a scaffolding that is strong and sturdy. Several individual scaffolding units will be placed side to side along the length of the building. The problem that arises is when a worker attempts to walk from one scaffolding unit to another. This person needs to traverse the top bar of each unit.

A worker, such as a mason carrying a load of bricks and mortar, will find such a maneuver difficult. Climbing over the top bars will prove not only time-consuming but also potentially hazardous. What is needed is a scaffolding unit that eliminates the top bar transversal problem while still maintaining the scaffolding's structural integrity.

BRIEF SUMMARY OF THE INVENTION

The present invention overcomes the top bar traversal problem. The present invention provides a scaffolding structure whereby the top bar is openable and closeable.

In an open position, part of the top bar slides into the second part of the top bar. In such an open position, a worker can pass from scaffolding unit to scaffolding unit without having to climb over the bar.

In a closed position, the top bar is locked into a fully extended position connecting the two vertical posts. In such a position, the top bar can bear a load such as a loaded plank rest bar.

The scaffolding of the present invention can be optionally constructed from tubing that is rectangular in cross-section. Rectangular cross-section tubing provides a scaffolding unit that is structurally strong yet easy to assemble and disassemble.

Therefore, it is an object of the present invention to provide an improved scaffolding jack system that can be easily traversed by a construction worker.

It is another object of the present invention to provide an improved scaffolding jack system that is structurally strong and stable.

It is a final object of the present invention to provide an improved scaffolding jack system that can be assembled and disassembled relatively quickly and easily.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
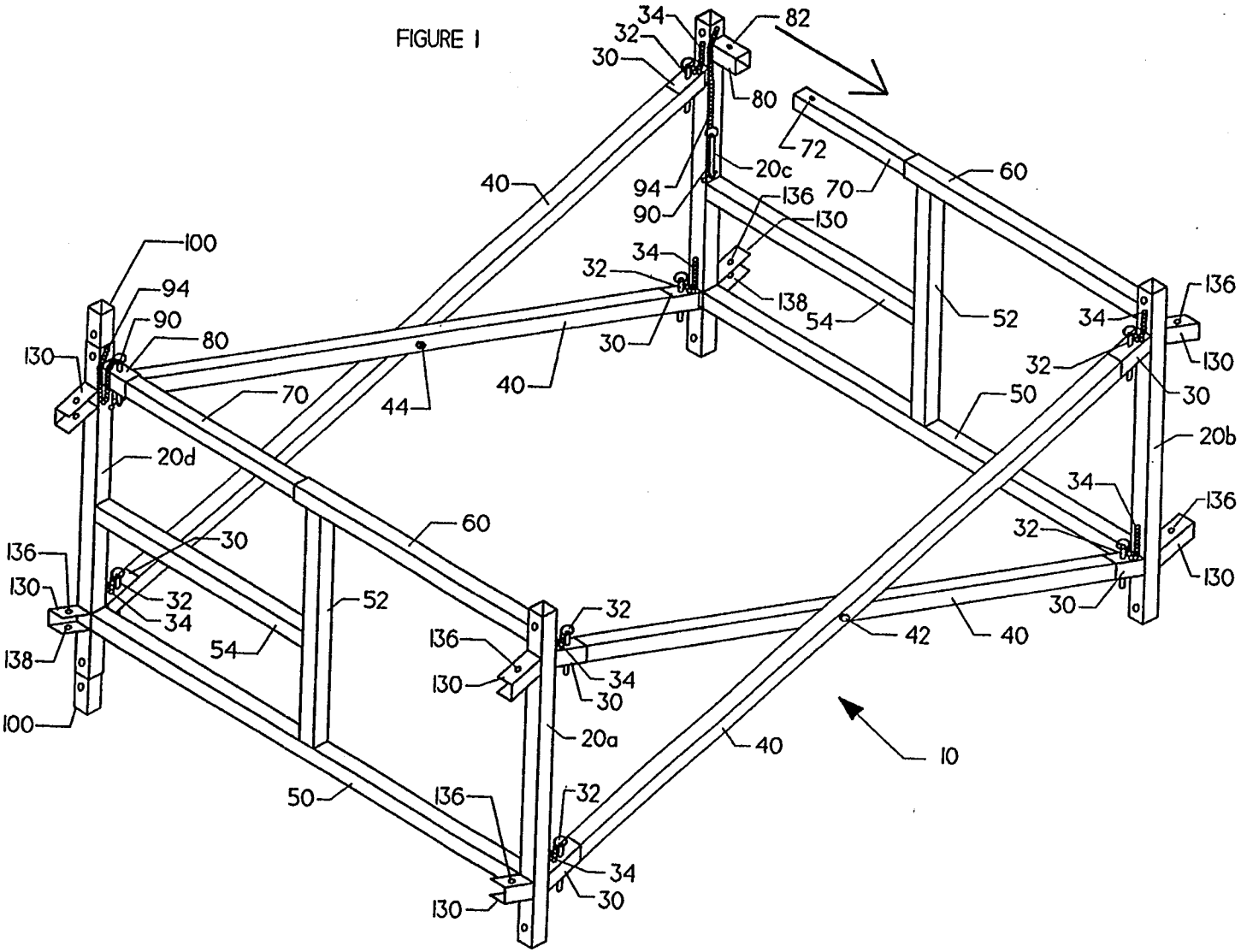
FIG. 1 is a perspective view of the scaffolding of the present invention.
Figure 2C:
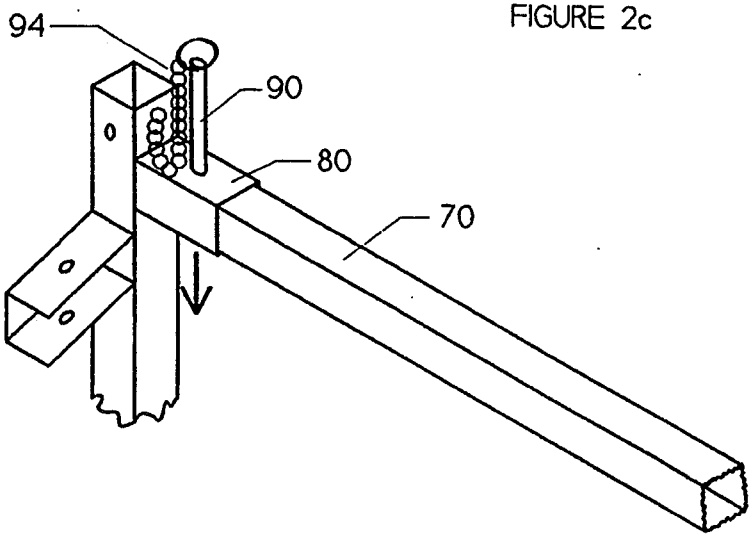
FIGS. 2*a* through 2*d* various views of the sliding gate of the present invention being placed into a closed position.
Figure 2D:
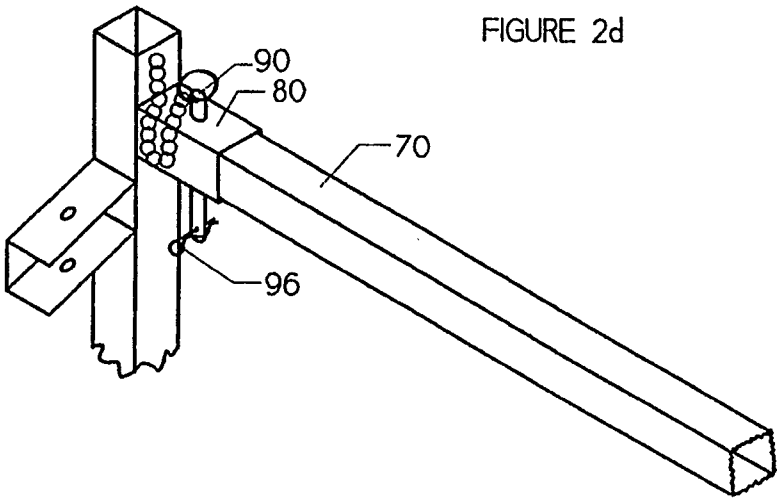
Figure 2A:
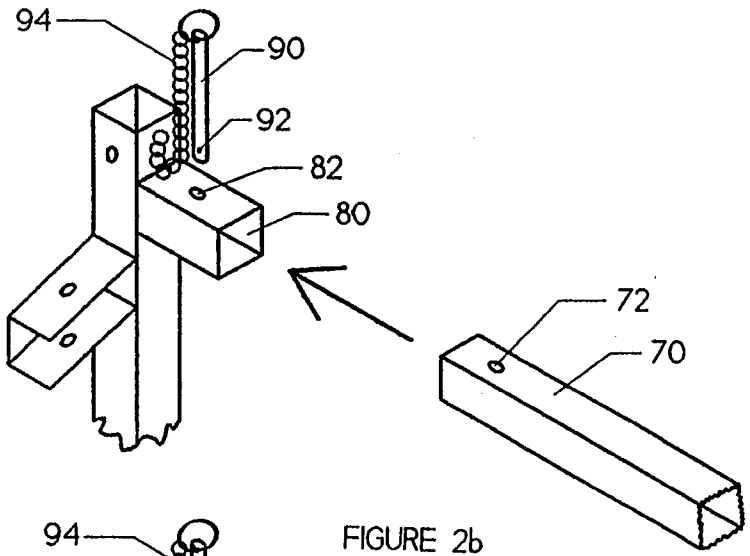
Figure 2B:
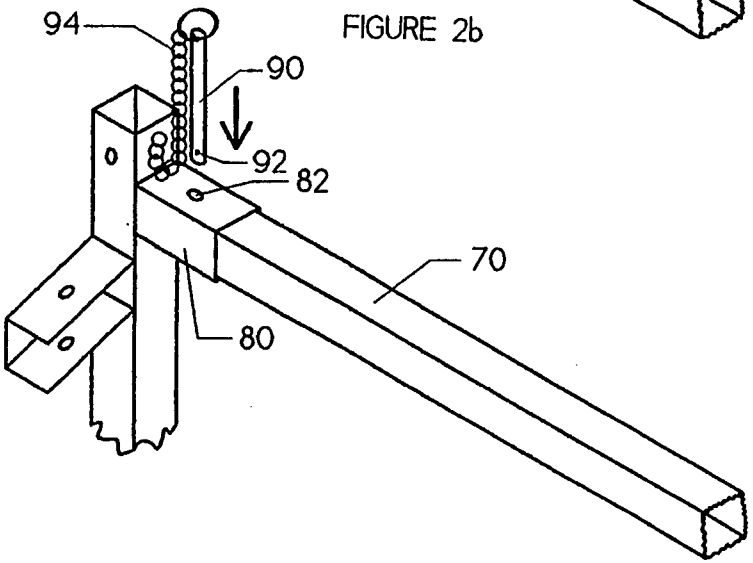

FIG. 1 shows a typical unit of scaffolding 10. A first vertical post 20*a*, second vertical post 20*b*, third vertical post 20*c*, and forth vertical post 20*d* define the outer corners of the scaffolding. At the bottom of the first vertical post 20*a* is a brace clip 30. At the bottom of the first vertical post is another brace clip 30. Further brace clips are similarly located on the other three vertical posts. These braces clips receive the brace bars 40 (described below) that define this unit of scaffolding.

All the brace clips are welded to the vertical posts. The brace clips are hollow channels which have a rectangular cross-section. The opening to the channel faces the interior of the scaffolding structure. The brace clips have an aperture 136 on the top surface and a second aperture 138 on the bottom surface. The two apertures are aligned.

Received within the channel of the upper brace clip 30 on the first vertical bar 20*a* is a brace bar 40. The brace bar extends outwardly and upwardly and is received within the upper brace clip 30 on the second vertical post 20*b*. The brace bar 40 is a hollow tube with a rectangular cross-section. The outer cross-section of the brace bar 40 is slightly smaller than the inside cross-section of the brace clip channel so that the brace clips 30 can receive the brace bar.

A second brace bar 40 is received in the upper brace clip 30 of the second vertical post 20*b* and extends outwardly and downwardly and is received within the lower brace clip of the first vertical post 20*a*. A second set of brace bars connect the third vertical post 20*c* to the fourth vertical post 20*d*.

On the upper surface at each end of the brace bar is an aperture (not illustrated). On the lower surface of each end of the brace is a second aperture (not illustrated). The two apertures at each end are aligned.

When the brace bars 40 are received within the channel brace clip 30, the lower and upper apertures of the brace bar are aligned with the lower and upper aperture of the brace clip. A jack pin 32 is inserted through the four apertures and holds the brace bars firmly within the brace clip. A cotter pin (not illustrated) is inserted through the an aperture on the jack pin 32 to hold the jack pin in place. A safety chain is 34 connected to the top of the jack pin 32. The other end of the safety chain 34 is permanently attached to the vertical post. The safety chain 34 assures that the jack pin is not lost.

On the left surface at the midpoint of each brace bar 40 is an aperture (not illustrated). On the right surface at the midpoint of each brace bar 40 is a second aperture (not illustrated). The two apertures are aligned. The brace bars 40 intersect one another at their midpoints. When so intersected, the midpoint apertures on each brace bar 40 are aligned at the cross-over point of the two brace bars 40. A bolt 42 and nut 44 structure secure the two brace bars 40 to one another at their midpoints.

The above describes a single section that defines the length of the scaffolding. Several sections of length can be strung together. To attach a second scaffolding structure to this first structure another set of brace bars (not illustrated) would be received in the connecting brace clips 130. All connections and components would be identical.

The first vertical post 20*a* is connected to the fourth vertical post 20*d* by a bottom bar 50. The bottom bar 50 is welded to each vertical post.

Extending upwardly from the approximate midpoint of the bottom bar 50 is a center post 52. The center post 52 meets the bottom bar 50 at a right angle and is welded to the bottom bar 50. Extending outwardly from the approximate midpoint of the center post 52 to the approximate midpoint of the fourth vertical post 20*d* is a plank rest bar 54. The plank rest bar 54 meets both the center post 52 and the fourth vertical post 20*d* at right angles. The plank rest bar 54 is welded to both the center post 52 and fourth vertical post 20*d*.

Extending outwardly from the top of the first vertical post 20*a* is a top bar 60. The top bar 60 meets the first vertical post 20*a* at a right angle and is welded to the first vertical post 20*a*. The top bar 60 extends slightly past the upwardly extended center post 52. The center post 52 meets the top bar 60 at a right angle and is welded to the top bar 60.

The top bar 60 is a hollow tube that has a rectangular cross-section. The hollow inner cross-section is also rectangular.

A sliding gate 70 is disposed within the hollow inner section of the top bar 60. The sliding gate 70 is a rectangular tube that has a cross-section that is slightly smaller than the cross-section of the top bar's inner hollow section. This permits the sliding gate 70 to slide freely into and out of the top bar 60.

The length of the sliding gate 70 is longer than the length of the top bar 60. This will assure that when the sliding gate 70 is slid as far back into the top bar 60 as possible (into an open position), a part of the sliding gate 70 will protrude from the top bar 60, permitting a worker to grasp the sliding gate 70.

At the sliding gate's protruding end is a first aperture 72 and a second aperture (not illustrated). The first aperture 72 is located on the top surface and the second aperture is located on the bottom surface. The two apertures are aligned.

Located on the fourth vertical post 20*d* and extending outwardly is a receiver 80. The receiver 80 is located at the same height as the top bar 60 . The receiver 80 is a short hollow tube that has a rectangular cross-section. The inner hollow cross-section is also rectangular. The cross-section of the sliding gate 70 is slightly smaller than the cross-section of the hollow inner diameter of the receiver 80. The receiver 80 has a first aperture 82 and a second aperture (not illustrated). The first aperture 82 is located on the receiver's top surface while the second aperture is located on the receiver's bottom surface. The two apertures are aligned.

FIGS. 2*a* through 2*d* illustrate how to put the sliding gate into a closed position. The sliding gate 70 is slid into and received by the receiver 80. The sliding gate's first and second apertures are aligned with the receiver's first and second apertures. A jack pin 90 is inserted through the four apertures to hold the sliding gate 70 in a closed position.

A cotter pin 96 is inserted through an aperture 94 located on the jack pin 90 to hold the jack pin 90 in place. A safety chain 94 permanently hold jack pin to the fourth vertical post 20*d*.

In order to open the sliding gate 70, the cotter pin would be received from the jack pin 90. The jack pin would be removed. The sliding gate 70 is then slid into the top bar 60.

The second vertical post 20*b* is connected to the third vertical post in a similar manner.

If several units of the scaffolding are connected along the length of a work site, then the sliding gate would be open at all interior sections. The sliding gates at the two ends would be closed. This will assure easy traversal of the length of the scaffolding structure by the job site workers.

For tall buildings, the scaffolding as described above, can be stacked on top of one another. An stacking pin 100 is illustrated protruding from the third vertical post 20*d*. The bottom of the stacking pin 100 extends down into the top of the third vertical post 20*d* several inches. The bottom of a corresponding vertical post (not illustrated) would receive the top of the stacking pin 100. An stacking pin 100 would be placed in each of the four vertical posts. Each stacking pin 100 would be held in place by a jack pin and cotter pin method.

In a stacked configuration all lower level scaffolding units would have their sliding gates closed.

All components of the scaffolding of the present invention can be constructed of a durable and sturdy material such a metal. If the components are constructed of metal, the metal can be coated with a rust-proofing finish.

The above scaffolding has been described with reference to rectangular tubing. However, the use of either round or other shaped tubing would work in a similar manner and would not detract from the spirit of the present invention. Furthermore, other changes in form and detail can be made without departing from the spirit or the scope of the invention.

We claim:

1. An improved jack system in the form of a rectangular scaffolding structure comprising a first vertical post, a second vertical post, a third vertical post, and a fourth vertical post wherein each vertical post defines a corner of said rectangular and is disposed horizontally;

a first cross brace diagonally connects the bottom of said first vertical post to the top of said second vertical post and a second cross brace diagonally connects said top of said first vertical post to the bottom of said second vertical post wherein the two cross braces cross over and are attached to each other at their respective middles by a first attachment means;

a third cross brace diagonally connects the bottom of said third vertical post to the top of said fourth vertical post and a fourth cross brace diagonally connects the top of said third vertical post to the bottom of said fourth vertical post wherein the two cross braces cross over and are attached to each other at their respective middles by a second attachment means;

wherein each cross brace is attached to its respective vertical posts by a connection means;

a first bottom bar horizontally connects the bottom of said first vertical post to the bottom of said fourth vertical post and is welded to each of the two vertical posts;

a second bottom bar horizontally connects the bottom of said second vertical post to the bottom of said third vertical post and is welded to each of the two vertical posts;

a first center post is welded to the midpoint of the first bottom bar and extends upwardly and a second center post is welded to the midpoint of the second bottom bar and extends upwardly;

a first plank rest bar horizontally connects the midpoint of said first center post to the midpoint of said fourth vertical post and is welded to said first center post and said fourth vertical post and a second plank rest bar horizontally connects the midpoint of said second center post to the midpoint of said third vertical post and is welded to said second center post and said third vertical post;

a first top bar is connected to said first vertical post extending horizontally outward toward said fourth vertical post and is welded to said first vertical post;

said first top bar rests on top of and is welded to said first center post;

a second top bar is connected to said second vertical post extending horizontally outward toward said third vertical post and is weld to said second vertical post;

said second top bar rests on top of and is welded to said second center post;

said first top bar and said second top bar are tubes each having a hollow inside section;

a first gate generally having the same geometric shape as said inside hollow section of said first top bar is slidably disposed within said first top bar;

a second gate generally having the same geometric shape as said inside hollow section of said second top bar is slidably disposed within said second top bar;

a first receiver is welded to said fourth vertical post and face said first vertical post wherein said first receiver is a short tube having a hollow inner section generally having the same geometric shape of said first sliding gate and wherein said first receiver receives said first gate when said first gate is slide outwardly from said first top bar;

a first latching means secures said first gate within said first receiver;

a second receiver is welded to said third vertical post and faces said second vertical post wherein said second receiver is a short tube having a hollow inner section generally having the same geometric shape of said second sliding gate and wherein said second receiver receives said second gate when said second gate is slide outwardly from said second top bar; and a second latching means secures said second gate within said second receiver.

2. An improved jack system as in claim 1 wherein said connection means each comprise a brace clip;

said brace clip being a short hollow channel welded to its respective vertical post with said channel generally having the same geometric shape as said cross braces;

wherein said brace clip receives said cross brace; and said cross brace is secured within said brace clip by a locking means.

3. An improved jack system as in claim 2 wherein said locking means comprises a jack pin being inserted through a first and second aperture located on said cross brace and through a third and fourth aperture located on said brace clip wherein all four apertures are aligned.

4. An improved jack system as in claim 1 wherein said first latching means comprises a jack pin being inserted through a first and second aperture located on said gate and through a third and fourth aperture located on said receiver wherein all four apertures are aligned when said first gate is fully extended outwardly from said first top bar; and wherein said second latching means is identical in structure and operation as said first latching means.

5. An improved jack system as in claim 1 wherein said first gate is longer than said first top bar and said second gate is longer than said second top bar.

6. An improved jack system as in claim 1 wherein said first vertical post, said second vertical post, said third vertical post, and said fourth vertical post each have a rectangular cross-section.

7. An improved jack system as in claim 1 wherein said first cross brace, said second cross brace, said third cross brace, and said fourth cross brace and said inner hollow space of each said brace clip each have a rectangular cross-section.

8. An improved jack system as in claim 1 wherein said first bottom bar, said second bottom bar, said first center post, said second center post, said first plank rest bar, said second plank rest bar, said first top bar, said inner space of said first top bar, said second top bar, said second inner hollow space of said second top bar, said first gate, said second gate, said inner hollow space of said first receiver, and said inner hollow space of said second receiver each have a rectangular cross-section.

* * * * *